US008499682B2

(12) United States Patent
Zangerle

(10) Patent No.: US 8,499,682 B2
(45) Date of Patent: Aug. 6, 2013

(54) LABYRINTH CAPSULE FOR DRINK POWDER

(75) Inventor: Wolfgang Zangerle, Mellingen (CH)

(73) Assignee: Nestec S.A., Vevey (CH)

( * ) Notice: Subject to any disclaimer, the term of this patent is extended or adjusted under 35 U.S.C. 154(b) by 356 days.

(21) Appl. No.: 12/812,807

(22) PCT Filed: Feb. 6, 2008

(86) PCT No.: PCT/IB2008/000321

§ 371 (c)(1),
(2), (4) Date: Jul. 30, 2010

(87) PCT Pub. No.: WO2008/087553

PCT Pub. Date: Jul. 24, 2008

(65) Prior Publication Data

US 2010/0307930 A1 Dec. 9, 2010

(51) Int. Cl.
*A47J 31/06* (2006.01)

(52) U.S. Cl.
USPC ..... 99/295; 426/590

(58) Field of Classification Search
USPC ..... 99/295, 279, 285, 275, 323.2, 281, 99/300; 220/501–502, 88; 206/219, 5; 426/590, 112, 78, 506, 110, 77, 431
See application file for complete search history.

(56) References Cited

U.S. PATENT DOCUMENTS

2004/0228955 A1* 11/2004 Denisart et al. ..... 426/590
2007/0186784 A1* 8/2007 Liverani et al. ..... 99/295

FOREIGN PATENT DOCUMENTS

DE 1429932 A1 3/1969
EP 1500358 1/2005
WO WO03/059778 A 7/2003
WO WO2006/021405 A 3/2006

* cited by examiner

*Primary Examiner* — Henry Yuen
*Assistant Examiner* — Phuong Nguyen
(74) *Attorney, Agent, or Firm* — CUSPA Technology Law Associates; Yi Li

(57) ABSTRACT

The labyrinth capsule consists of a cup-shaped capsule wall (1), the capsule base formed from a labyrinth plate (4) having a labyrinth structure and puncturing pins (14) on its upper side. A hole (10) with a central round stud (12) is located in the labyrinth plate center. A sealing film (7) is placed on the labyrinth plate and is welded along its edge to the edge of the labyrinth plate. The capsule wall (1) is sealed on its upper edge (2) with a closure film, thereby closing in the filling. When liquid presses in through the closure film, the sealing film is pressed against the labyrinth plate. The puncturing pins puncture the sealing film. The liquid flows through the puncture holes to the labyrinth plate and drains out between the labyrinth ridges (5). Finally, a laminar liquid stream is formed from the round stud in the spout hole (10).

19 Claims, 4 Drawing Sheets

LABYRINTH CAPSULE FOR DRINK POWDER

This invention relates to a labyrinth capsule which contains a powder for the preparation of a drink. Capsules of this type are used primarily for the preparation by machine of coffee. However, such a capsule may also contain different powders, for example lemonade tablet powder, powder for the preparation of syrups or tea, etc. The task of the capsule is to temporarily store said powder and then by means of instant preparation by machine to provide an excellent quality of drink. For this purpose, hot or cold water is pressed under pressure through the capsule and is shaped by the same to form a discharge jet which flows in as laminar a manner as possible and does not flow too rapidly so as to avoid splashes. In addition, the water is to be intimately mixed in the interior of the capsule with the powder such that the latter is completely dissolved in the water flowing through it.

Conventional capsules comprise a thermoformed small plastic cup, the base of which, however, is curved outward and is prepared in the center to be pierced by a spike, thus producing a round discharge hole. A labyrinth plate with a toothed outer edge is placed onto the inside of the cup base. On the same side of said plate, which side is directed toward the base, said plate forms a labyrinth structure with a central piercing spike to create the discharge hole, while it has a multiplicity of piercing spikes on the upwardly directed side. A sealing film made from aluminum or plastic is then placed from above onto said plate. After filling with powder, the entire cup-like capsule is closed at the top with a sealing film. In order to prepare drinks with the associated machine, said sealing film is pierced and brewing liquid, generally hot water, is forced under high pressure through the hole produced into the capsule. The liquid penetrates the powder under high pressure. The hydrostatic pressure presses the edge of the sealing film against the cup wall and furthermore seals it off there. However, the piercing spikes on the inserted labyrinth plate penetrate the sealing film. The liquid with the powder dissolved therein flows through the many holes produced in the sealing film. Below the sealing film, the liquid flows radially toward the edge of the labyrinth plate and flows around the edge thereof between the tooth spaces of the toothed edge. The liquid then flows through the labyrinth on the plate toward the discharge hole which has been produced in the center of the cup or capsule base in the meantime by the labyrinth plate pressing thereagainst. The liquid is discharged there and forms a jet.

However, these previous capsules have a complicated construction. They do not always ensure a jet which is discharged in a neatly laminar manner, but rather jets or partial jets which often emerge at an oblique angle with respect to the axis of rotation occur. The thorough mixing or the dissolving of the powder through which the flow passes is also inconsistent and is therefore not satisfactory.

The reasons for these disadvantages are that the piercing labyrinth plate is merely placed into the capsule and is not securely positioned there. Said plate can therefore be displaced somewhat out of the center. If this happens, the flow does not pass uniformly all around the edge. A further consequence is that the discharge hole is then also not produced precisely in the center of the capsule base, but rather is offset laterally somewhat. A jet which emerges at an oblique angle is then produced. Flow through the labyrinth is not always ensured. Since the labyrinth plate is merely placed in, it may rise somewhat in the cup under the liquid pressure of the liquid flowing around its edge. This leads to the liquid flowing under the labyrinth along the base of the cup to the discharge hole and no longer actually flowing through the labyrinth. Intimate thorough mixing by means of swirling in the labyrinth cannot then be obtained. Correspondingly, good dissolution of the powder in the liquid flowing through it is then not ensured.

The object of the present invention is therefore to provide a labyrinth capsule for drink powder that overcomes the abovementioned disadvantages.

This object is achieved by a labyrinth capsule for drink powder, comprising a cup-shaped capsule, the capsule base of which is formed by a labyrinth plate which has a labyrinth structure and piercing spikes on its upper side, and a hole with a central round stud in the center, and onto which labyrinth plate a sealing film is placed and is welded directly or indirectly along its edge to the edge of the labyrinth plate, and is welded to the webs of the labyrinth structure in the first half of the radius of the labyrinth plate, wherein the capsule is sealed at its upper edge with a closing film, with the filling being enclosed.

The drawings illustrate the components of said labyrinth capsule, and also the assembled capsule, and, with reference to said drawings, the capsule is described below using a number of variant embodiments, and its function is explained.

Figure 1:
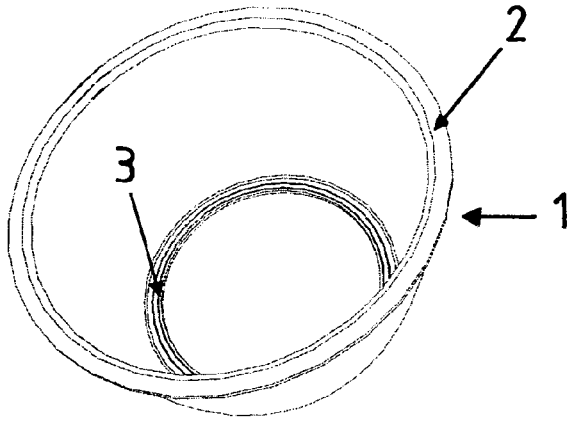
FIG. 1 shows the cup-like capsule without a capsule base.

FIG. 1 shows the first component of said capsule, which is composed of a total of four parts, for drink powder, for example for coffee, or for lemonade tablet powder. Said first component forms the conical wall 1 of a cup-like capsule, with a projecting edge 2 on the upper side and with an inwardly projecting edge 3 on the lower side. In most cases, said component is produced by thermoforming from a laminate plastic with a barrier function which can ensure the required gastightness. A respective bead preferably runs on the projecting edges 2, 3 as an energy direction transmitter ERG for the subsequent welding of a sealing film onto the upper edge 2 and of a labyrinth plate onto the lower edge 3. If no gastightness, i.e. no absolute oxygen tightness for the filling, is required, then the cup can also be manufactured together with the base in the form of a single piece injection molded part. In this case, the base at the same time forms the labyrinth plate, as will become clear. In this case, the base which forms the labyrinth plate then has a shoulder at its edge for the welding on of a sealing film, and said shoulder can be provided with a bead as an energy direction transmitter ERG for the sealing film which is to be welded on.

Figure 2:
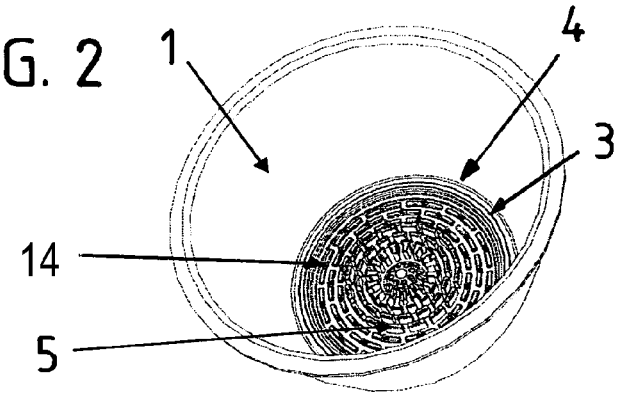
FIG. 2 shows the cup-like capsule without a capsule base, with the labyrinth plate sealed into it.

FIG. 2 shows the capsule with the labyrinth plate 4 as the capsule base. This is either—if the capsule wall 1 is thermoformed—a separately produced injection molded part which is then welded as the base into the capsule wall 1, and for which purpose the labyrinth plate 4 is welded onto that edge 3 of the capsule wall 1 which projects inward at the bottom, or else, in a different case, the labyrinth plate 4 is manufactured as one piece with the capsule wall 1 as an injection molded part. In each case, however, said labyrinth plate 4 which ultimately forms the capsule base has a labyrinth on its upper side by, for example, as shown here, a number of concentrically arranged labyrinth webs 5 which all project upward being integrally formed on its upper side. In the outer peripheral region of the labyrinth plate 4, the webs 5 are equipped with an additional, upwardly projecting piercing spike 14.

Figure 3:
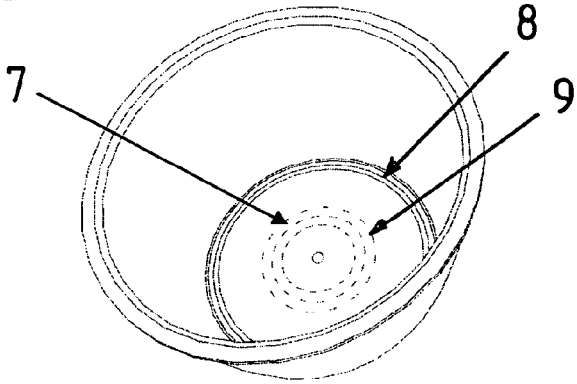
FIG. 3 shows the cup-like capsule without a capsule base and with the labyrinth plate sealed into it and a sealing film welded onto it.

Starting from the view in FIG. 2, a sealing film 7 is welded onto the labyrinth plate 4 such that subsequently the capsule is presented as illustrated in FIG. 3. The welding takes place along the peripheral edge 8 of the sealing film and additionally at those points 9 of the sealing film which are shown by dashed lines by the sealing film 7 being welded there onto the labyrinth webs 5 located therebeneath.

Figure 4:
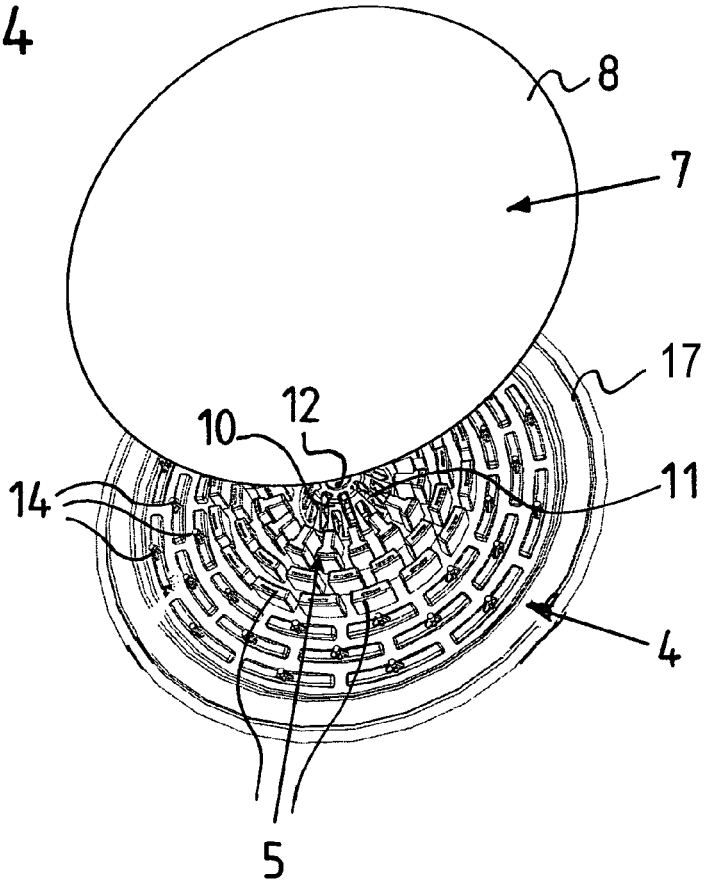
FIG. 4 shows the labyrinth plate as seen from above in an enlarged illustration, with a sealing film which is to be welded onto it.

FIG. 4 shows the construction of the labyrinth plate 4 in an enlarged view, and the sealing film 7 which is to be welded onto it. In the center of the labyrinth plate 4, the latter has a discharge hole 10 over which is integrally formed a basket 11 which spans the hole 10 and in the center of which a round stud 12 extends downward through the hole 10. The liquid then flows through the basket 11 into the discharge hole 10, and because there is a round stud 12 in the center of said discharge hole, the flow passes around said round stud and, upon exit, the liquid jet as a whole can be tapered and therefore a largely laminar liquid jet is formed. The round stud 12 therefore contributes to forming a laminar flow. The sealing film 7 is welded onto said labyrinth plate 4, to be precise is welded along its outer edge region 8 onto the outer edge of the labyrinth plate 4 which, for this purpose, is provided with a bead 17 as an energy direction transmitter. In addition, the sealing film 7 is also welded to the inner labyrinth webs 5 which are flat at the top and are arranged in concentric circles. By contrast, the outer, concentrically arranged webs are all equipped with an upwardly projecting piercing spike 14. When the sealing film 7 is welded onto the labyrinth plate 4, said sealing film initially remains intact. It is itself composed of a laminate plastic, is oxygen-tight and, together with the capsule wall 1, if the latter is thermoformed, seals the filling in an oxygen-tight manner. By contrast, if the capsule wall 1 and the labyrinth plate 4 are injection molded, then the sealing film does not absolutely need to be oxygen-tight, if the injection-molded version is produced in such a manner that a barrier layer is placed into the center of the wall in a co-injection process. In this case, the film has to have the same barrier properties.

Figure 5:
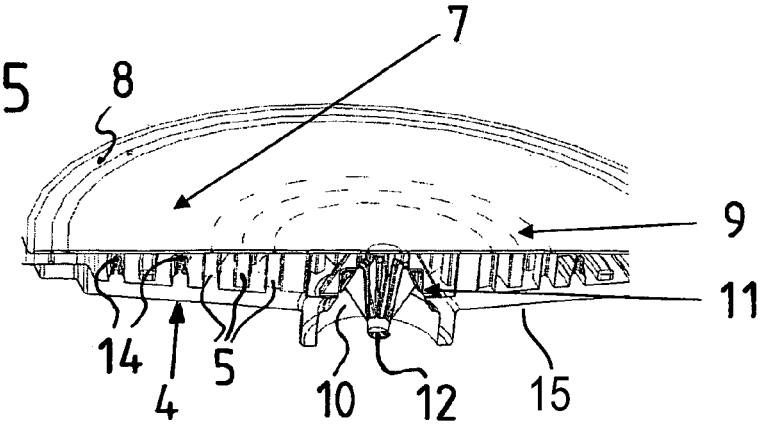
FIG. 5 shows, in a cross section, the labyrinth plate with the sealing film welded onto it.

FIG. 5 shows a cross section of the labyrinth plate 4 with the sealing film 7 welded onto it. Instead of a slightly conical plate as shown here, said plate can also be of flat design on its lower side. As can be seen, the labyrinth webs 5 within the first half of the radius of the labyrinth plate 4 are welded to the sealing film 7 while the outer webs do not touch the sealing film 7. Upwardly projecting piercing spikes 14 which end shortly before the lower side of the sealing film 7 are integrally formed on said outer webs for this purpose. The sealing film 7 is also welded with its peripheral edge region 8 to that edge of the labyrinth plate 4 which is located therebelow. In the center of the labyrinth plate 4, the discharge hole 10, the basket 11 which is arranged above the discharge hole and spans the discharge hole 10, and the round stud 12 which is directed downward therein and ensures a largely laminar jet when the liquid is discharged from the upper side of the labyrinth plate 4 can be seen. As soon as the sealing film 7 is perforated by the hydrostatic pressure of the liquid flowing into the capsule from above, the liquid therefore flows through said perforation holes and then flows counter to the radial direction toward the center of the labyrinth plate 4. Since the inner webs 5 are welded to the sealing film 7, the liquid is forced to flow through the labyrinth formed by them, and because of the swirling produced therein, thorough mixing of the liquid with the powder and dissolving of the powder in the liquid are promoted.

Figure 6:
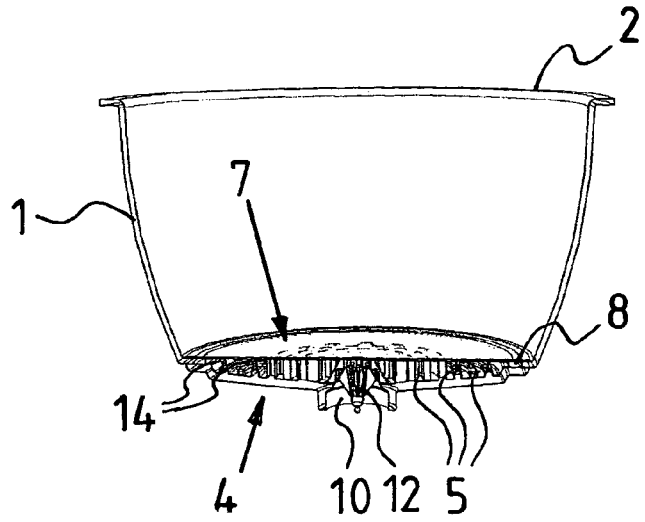
FIG. 6 shows, in a cross section, the cup-like capsule with the labyrinth plate and sealing film.

FIG. 6 shows, in a cross section, said capsule 1 for drink powder. The region above the sealing film 7 is completely tight, in the event of a thermoformed capsule wall made of laminate plastic and an oxygen-tight sealing film 7 is even oxygen-tight and is therefore especially suitable for filling materials which easily react with oxygen. The labyrinth plate 4 produced separately by injection molding was first of all inserted into the capsule wall 1 and welded to the lower edge thereof. The sealing film 7 was then inserted from above and welded onto the peripheral edge and the inner labyrinth webs 5 of the labyrinth plate 4. If, on the other hand, the capsule is produced together with the labyrinth plate 4 by injection molding, then just the sealing film 7 is inserted and welded along its edge 8 to the labyrinth plate 4 and also to the inner labyrinth webs 5 thereof. After the capsule 1 is filled with the drink powder, the upper edge 2 of the capsule 1 is sealed with a closing film. This closing film may be, for example, an aluminum foil which then closes the contents in an oxygen-tight manner, or else a simple plastic film if the oxygen-tightness does not have to be ensured, or else a laminate plastic film made of the same or similar material as the sealing film 7 which is welded at the bottom onto the labyrinth plate 4.

Figure 7:
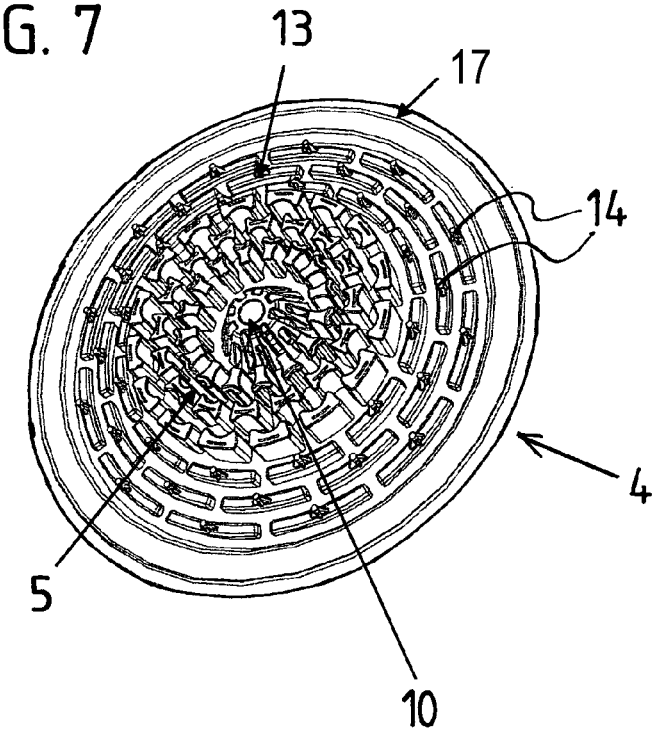
FIG. 7 shows a different variant of the design of the labyrinth plate.

FIG. 7 shows a different variant of the design of the labyrinth plate 4. In the inner region of its radius, it has labyrinth webs 5 which have a particular shape. This is because the side walls thereof form concave indentations such that channels located vertically on the labyrinth plate 4 are formed. In outline, the labyrinth webs 5 on the central ring, approximately at half the height of the radius, initially form small rectangular blocks which are arranged with their longitudinal side along a concentric circle on the labyrinth plate 4. The insides of said labyrinth webs 5 then form in each case a channel situated vertically on the labyrinth plate 4. The labyrinth webs 5 which are next on the inside are likewise initially small rectangular blocks in outline which are likewise arranged with their longitudinal side along a concentric circle, but are also all offset with respect to the radial between two outer, opposite labyrinth webs of the outermost ring, i.e. in relation to the same. These labyrinth webs 5 of said ring which follows next to the inside then form with their outer side and also on their inner side a vertical channel in each case, i.e. a concave indentation. On the ring following next to the inside, the labyrinth webs are in turn each arranged between the labyrinth webs of the preceding ring and are shaped concavely on their outer side. If a liquid then flows toward the center of the labyrinth plate 4 counter to the radial thereon, it is forced by said three rings of labyrinth webs 5 and their concave outsides and insides into a meandering flow. Said flow promotes intimate mixing of the liquid with the powder. The labyrinth webs 5 arranged in the outer half of the radius of the labyrinth plate 4 are formed from curved elements 13 with vertically upwardly protruding piercing spikes 14, with the curved elements 13 being arranged on concentric circles such that the liquid also has to flow around them. However, said curved elements 13 are substantially lower than the remaining labyrinth webs 5.

Figure 8:
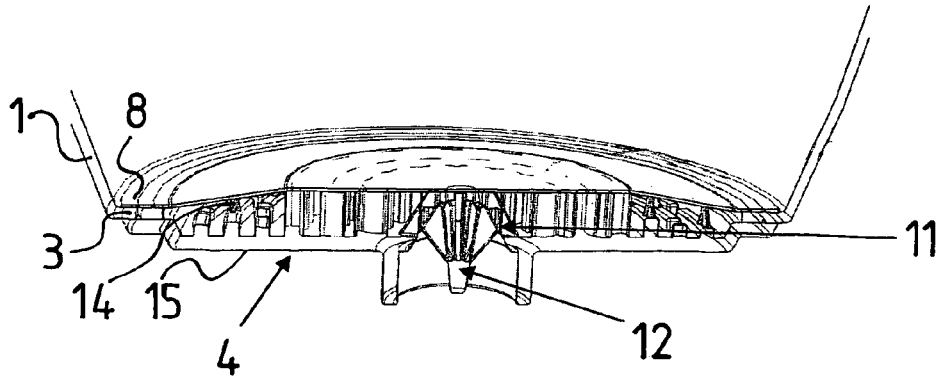
FIG. 8 shows, in a cross section, said labyrinth plate with the sealing film welded onto it.

FIG. 8 shows, in a cross section, this labyrinth plate 4 with the sealing film 7 welded onto it. As can be seen, the labyrinth plate 4 is designed here with a flat base 15. The labyrinth webs 5 in the first half of the radius of the labyrinth plate 4 are all identical in height such that the sealing film 7, which is welded onto them, has a flat profile. On the outside, the sealing film 7 drops downward in the radial direction and is welded here with its edge 8 to the upper side of the lower edge 3 of the cup 1. A small intermediate space remains free between the piercing spikes 14 and the lower side of the sealing film 7. As soon as the sealing film 7 is subjected to sufficient hydraulic pressure from above, it is forced downward and then the piercing spikes 14 pierce the sealing film 7.

Figure 9:
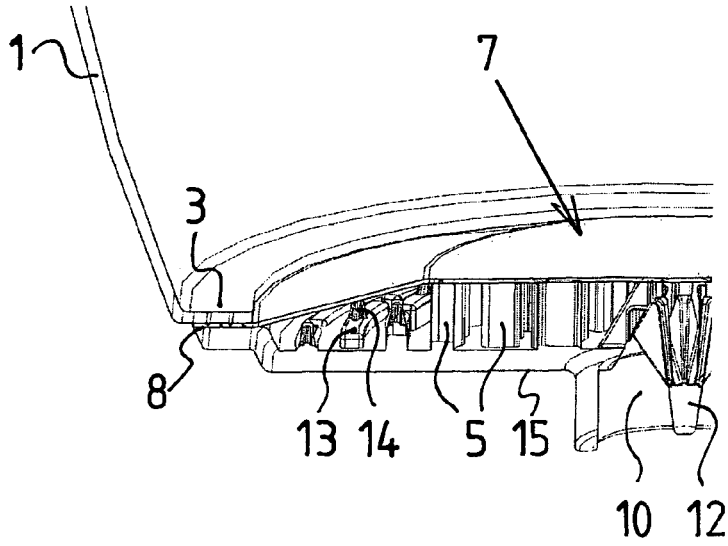
FIG. 9 shows an alternative variant of welding the labyrinth plate to the sealing film.

FIG. 9 finally shows another alternative variant of the welding of the labyrinth plate 4 to the sealing film 7. Here, the lower side of the outer edge 8 of the sealing film 7 is namely welded directly to the upper side of the outer edge of the labyrinth plate 4. This affords the advantage that the slightly varying thicknesses of the lower, inwardly projecting edge 3 of the cup 1 can no longer be of any significance. This lower edge 3 of the cup 1 is then namely welded, as shown here, onto the upper side of the edge of the sealing film 7. If, by contrast, said projecting edge 3 is welded between the sealing film 7 and labyrinth plate 4, then its edge thickness which varies slightly because of production by thermoforming has the effect that the distance between the sealing film 7 and the piercing spikes 14 is not identical overall and a definitive distance cannot be precisely maintained. Therefore, in the case of this way of welding the cup edge 3, reliable piercing over the entire circumference is not ensured. However, with the welding shown here, a remedy can be provided, since the distances between sealing film 7 and piercing spikes 14 are thus defined precisely and are invariable.

When liquid is forced through the closing film, the sealing film 7 is forced onto the labyrinth plate 4. The piercing spikes 14 pierce the sealing film 7. The liquid flows through the pierced holes and then flows on the lower side of the labyrinth plate 4 through the labyrinth comprising the labyrinth webs 5. Finally, a laminar liquid jet is formed by the round spike 12 in the discharge hole 10. This capsule for drink powder ensures a consistently good mixing and dissolution of the powder in the liquid passing through it. It produces a largely laminar liquid jet and is still simple to produce, particularly if it merely comprises an injection molded part and a sealing film 7 to be welded into place on it.

The invention claimed is:

1. A labyrinth capsule for drink powder, comprising:

a capsule wall (1);

a capsule base in a form of a labyrinth plate (4) at a lower side of the capsule wall (1), the labyrinth plate (4) having a discharge hole (10) at a center thereof with a round stud (12) extending axially downward through the discharge hole, and a labyrinth structure formed by a plurality of upwardly projecting labyrinth webs (5) on an upper side of a base (15) of the labyrinth plate (4); in an outer peripheral region of the labyrinth plate the labyrinth webs further including upwardly projecting piercing spikes (14); wherein the labyrinth webs are mutually offset with respect to a radial direction; and a sealing film (7) placed on the labyrinth plate (4), welded onto the labyrinth webs (5) in an inner region of a radius of the labyrinth plate, and further welded along a peripheral edge region (8) thereof onto an outer edge of the labyrinth plate (4) or to a lower edge (3) of the capsule wall (1) wherein an intermediate space remains free between a lower side of the sealing film (7) and the piercing spikes (14) in the outer peripheral region of the labyrinth plate;

said labyrinth capsule being sealed at an upper edge (2) of the capsule wall (1) with a filling enclosed therein.

2. The labyrinth capsule according to claim 1, wherein the sealing film (7) is made of a laminate plastic film, adapted to be perforated by the piercing spikes (14) from underneath.

3. The labyrinth capsule according to claim 1, wherein the capsule wall (1) is thermoformed from a laminate plastic.

4. The labyrinth capsule according to claim 1, wherein the labyrinth webs in the inner region of the labyrinth plate have a flat top.

5. The labyrinth capsule according to claim 1, wherein the labyrinth webs in the outer peripheral region of the labyrinth plate are lower than the labyrinth webs in the inner region, and the piercing spikes (14) are disposed thereon.

6. The labyrinth capsule according to claim 1, wherein the labyrinth webs (5) are integrally formed on the base (15) of the labyrinth plate (4) and concentrically arranged.

7. The labyrinth capsule according to claim 1, wherein the labyrinth webs in the outer peripheral region of the labyrinth plate are curved annular elements mutually offset with respect to the radial direction, and each thereof has the upwardly projecting piercing spike (14) on the curved annular element.

8. The labyrinth capsule according to claim 1, wherein the labyrinth webs under the sealing film welded thereon forces a liquid flowing through perforation holes of the sealing film caused by the piercing spikes under pressure into a meandering flow toward the discharge hole of the labyrinth plate.

9. The labyrinth capsule according to claim 6, wherein the labyrinth webs have a concave indentation on inner or outer sidewalls thereof, forming a vertical channel on each of the labyrinth webs.

10. The labyrinth capsule according to claim 1, wherein the labyrinth webs in the inner region of the labyrinth plate have the same height and the sealing film (7) welded thereon has a flat profile at the inner region; and the sealing film (7) then inclines downward in a radial direction and has the peripheral edge region (8) thereof welded onto the lower edge (3) of the capsule wall.

11. The labyrinth capsule according to claim 1, wherein the labyrinth plate (4) has a basket (11) integrally formed over and spanning the discharge hole (10).

12. The labyrinth capsule according to claim 1, wherein the base (15) of the labyrinth plate (4) is conical or flat.

13. The labyrinth capsule according to claim 1, wherein the labyrinth plate (4) and the capsule wall (1) are formed as a single piece by injection molding.

14. The labyrinth capsule according to claim 1, wherein the labyrinth plate (4) is a separate component, welded to the lower edge (3) of the capsule wall (1).

15. The labyrinth capsule according to claim 14, wherein the peripheral edge region (8) of the sealing film (7) is welded onto the outer edge of the labyrinth plate (4).

16. The labyrinth capsule according to claim 14, wherein the lower edge (3) of the capsule wall (1) projects inwardly.

17. The labyrinth capsule according to claim 16, wherein the peripheral edge region (8) of the sealing film (7) is welded onto an upper side of the lower edge (3) of the capsule wall (1).

18. The labyrinth capsule according to claim 16, wherein the peripheral edge region (8) of the sealing film (7) is welded onto the outer edge of the labyrinth plate (4), and an upper side of the outer edge of the labyrinth plate (4) is welded to a lower side of the lower edge (3) of the capsule wall (1).

19. The labyrinth capsule according to claim 1, wherein the labyrinth plate (4) has a bead (17) on an upper side of the base (15) along the outer edge of the labyrinth plate.

* * * * *